US008052149B2

(12) United States Patent
Sweeting

(10) Patent No.: US 8,052,149 B2
(45) Date of Patent: Nov. 8, 2011

(54) INTERACTIVE CHOCOLATE BOARD GAME

(75) Inventor: Joan Sweeting, Islip, NY (US)

(73) Assignee: Madelaine Chocolate Novelties, Inc., Rockaway Beach, NY (US)

( * ) Notice: Subject to any disclaimer, the term of this patent is extended or adjusted under 35 U.S.C. 154(b) by 3 days.

(21) Appl. No.: 12/319,850

(22) Filed: Jan. 13, 2009

(65) Prior Publication Data

US 2010/0176552 A1 Jul. 15, 2010

(51) Int. Cl.
*A63F 3/00* (2006.01)

(52) U.S. Cl. ..... 273/287; 273/254

(58) Field of Classification Search ..... 273/254, 273/281, 282.1, 282.3, 287
See application file for complete search history.

(56) References Cited

U.S. PATENT DOCUMENTS

| | | | | | |
|---|---|---|---|---|---|
| 1,561,609 | A | * | 11/1925 | Kennedy | 273/282.1 |
| 2,069,106 | A | * | 1/1937 | Farley | 273/282.1 |
| 2,189,902 | A | * | 2/1940 | Hiser | 434/167 |
| 2,635,881 | A | * | 4/1953 | Cooney | 273/153 R |
| 2,778,642 | A | * | 1/1957 | Moore et al. | 273/270 |
| 3,002,491 | A | * | 10/1961 | Bachman | 116/225 |
| 3,096,092 | A | * | 7/1963 | Bredehorn | 273/272 |
| 3,394,935 | A | * | 7/1968 | Beauchaine | 273/240 |
| 3,665,618 | A | * | 5/1972 | Hahn | 273/270 |
| 3,732,629 | A | * | 5/1973 | Spitzner | 273/281 |
| 3,744,800 | A | * | 7/1973 | Campbell et al. | 273/268 |
| 3,942,800 | A | * | 3/1976 | Holbrook | 273/236 |
| 4,140,317 | A | * | 2/1979 | Ramney | 273/243 |
| 4,429,787 | A | | 2/1984 | Morse | |
| 5,213,664 | A | * | 5/1993 | Hansell | 162/134 |
| 5,657,899 | A | * | 8/1997 | Stoken | 463/17 |
| D412,942 | S | * | 8/1999 | Isabel | D21/392 |
| 6,138,823 | A | * | 10/2000 | Focke et al. | 206/259 |
| 6,186,553 | B1 | | 2/2001 | Phillips et al. | |
| 6,237,843 | B1 | * | 5/2001 | Falat et al. | 229/125.35 |
| 6,280,200 | B1 | | 8/2001 | Cunningham | |
| 6,352,258 | B1 | * | 3/2002 | Fitzgerald et al. | 273/138.1 |
| 6,877,744 | B2 | | 4/2005 | Such | |
| 7,090,253 | B2 | | 8/2006 | Phillips et al. | |
| 7,097,037 | B1 | * | 8/2006 | Keffeler et al. | 206/532 |
| 2006/0267276 | A1 | | 11/2006 | Farmer, Jr. | |
| 2006/0279038 | A1 | * | 12/2006 | Irwin et al. | 273/138.1 |

OTHER PUBLICATIONS

International Search Report, dated Mar. 22, 2010, for PCT/US2010/020917.

Written Opinion of the International Searching Authority, dated Mar. 22, 2010, for PCT/US2010/020917.

* cited by examiner

*Primary Examiner* — Vishu K. Mendiratta

(74) *Attorney, Agent, or Firm* — Amster Rothstein & Ebenstein LLP

(57) ABSTRACT

The present invention relates to an interactive board game comprising a playing surface having a series of tabs, wherein each opened tab reveals clues or directions to the next tab to be opened. In one embodiment, the board game comprises individual cells containing a prize, such as a chocolate, located under each tab, which are accessible upon opening the tabs.

24 Claims, 5 Drawing Sheets

INTERACTIVE CHOCOLATE BOARD GAME

FIELD OF THE INVENTION

The present invention generally relates to an interactive board game comprising a series of tabs, wherein each opened tab reveals clues or directions to the next tab to be opened. In some embodiments of the preferred invention, prizes are located underneath each tab.

BACKGROUND OF THE INVENTION

Numerous board and parlor games are well known in the prior art and widely used both for entertainment as well as educational purposes. Many board games involve one or more players progressing from a starting point to an end point (e.g. Candyland®, etc.). However, these games often require a large playing surface, and numerous pieces and other game components.

Advent calendars are also well known in the art. Examples of such calendars are set forth in U.S. Pat. No. 6,280,200. U.S. Pat. No. 7,090,253, and U.S. Publication No. 2006/0267276. Basically, advent calendars are devices which serve as a countdown to a specific event of significance, usually a holiday. Beginning at a specific starting date, one new tab is opened each subsequent day, such that unopened tabs indicate the days left before the event. Prizes are often located behind each tab to assuage the anticipation of waiting for that particular event. Because advent calendars are necessarily tied to a particular event, one is limited to using the advent calendar during the period leading up to that event. Furthermore, because the tabs on the advent calendar each correspond to a specific day, there is no variation or uncertainty in the order they are opened. The user is limited to opening the tabs in chronological order.

SUMMARY OF THE INVENTION

In the present invention, applicant has created a board game wherein the player progresses through the game by opening a series of tabs based on clues or directions. As each tab is opened, it reveals clues or directions to the next tab to be opened. Specifically, the present invention is directed to a board game apparatus comprising (a) a playing surface, wherein the playing surface comprises a plurality of polygonal tabs, said tabs having a front and a back surface, wherein the tabs are moveable from a closed to an open position, (b) a design or image printed on the playing surface, and (c) printed text or images located on either the back surface of each tab or underneath each tab which are viewable upon opening of the tab, wherein the printed text or image provides a clue or directions to the next tab to be opened.

The present invention is further directed to a board game apparatus comprising (a) a lower layer having a first top surface, (b) an upper layer located above the lower layer and having a second top surface, (c) an outer wall connecting the border of the lower layer to the border of the upper layer, (d) a plurality of polygonal tabs formed in said upper layer, said tabs having a front and a back surface, wherein the tabs are moveable from a closed to an open position, (e) a design or image printed on said second top surface, and (f) printed text or images on the back surface of each tab or on the first top surface of the lower layer viewable upon opening of the tab, wherein the printed text or image provides a clue or directions to the next tab to be opened.

DETAILED DESCRIPTION OF THE INVENTION

Figure 1:
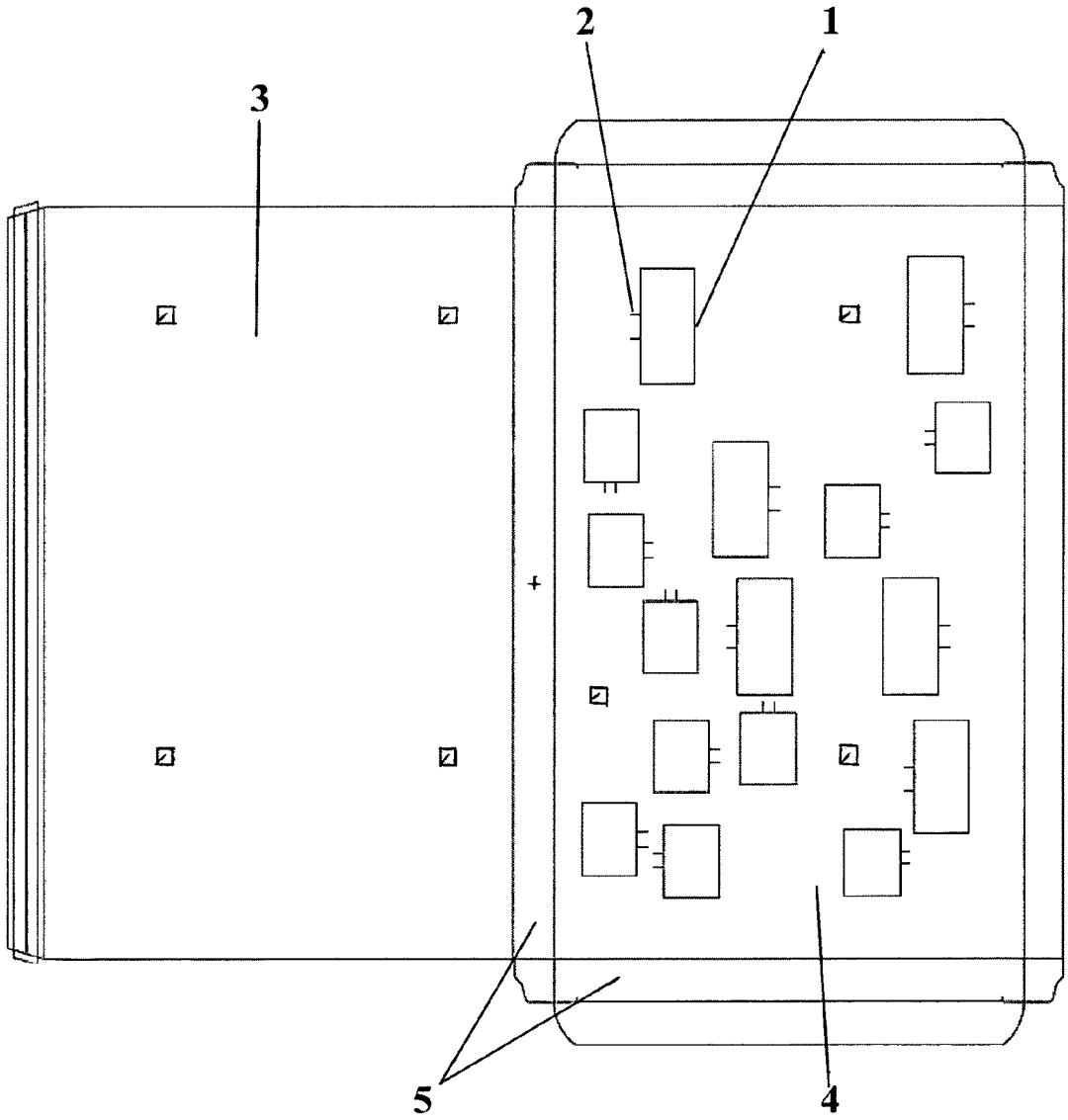
FIG. 1 shows one embodiment of the claimed invention without any printed design or image. In this embodiment, the tabs (e.g. 1) are located throughout the playing surface at positions which would ultimately align or correspond with specific portions of the design or image printed on the playing surface. The two lines (e.g. 2) appearing on each tab indicate the side at which that tab is to be opened (i.e. left, right, top or bottom). 3, 4 and 5 indicate the lower layer, the upper layer, and the outer wall, respectively.

The present invention provides a board game wherein the player begins at a designated starting point which provides a clue or direction to the next objective, which therein provides a clue or direction to the next objective and so forth, ultimately leading the player to the final tab.

Two-Dimensional Interactive Board Game

Specifically, the present invention is directed to a board game apparatus comprising (a) a playing surface, wherein the playing surface comprises a plurality of polygonal tabs, said tabs having a front and a back surface, wherein the tabs are moveable from a closed to an open position, (b) a design or image printed on the playing surface, wherein the design or image contains no indication of the order of tabs to be opened, and (c) printed text or images located on either the back surface of each tab or underneath each tab which are viewable upon opening of the tab, wherein the printed text or image provides a clue or directions to the next tab to be opened.

To play the game, the player is provided the location of the starting tab, which when opened, reveals a clue, such as a riddle, or directions to the next tab. This process is repeated until the player reaches the final tab. In the preferred embodiment, the final tab indicates that the player has reached the end of the game, at which point, the player can check to see if any tabs are unopened, which would indicate that the player had made a mistake or has missed a tab. In the preferred embodiment, the printed text or image on the back surface of each tab or underneath each tab directs the player to a section of the printed design or image on the playing surface corresponding to the location of the next tab to be opened.

Because the tabs in the claimed invention do not correspond to any specific date or time period as they are in an advent calendar, the claimed invention can be played at any time. Furthermore, the player can choose to play the game to completion at one time, or spread the game out over a period of time (e.g. opening up one tab a day).

In one embodiment, the claimed invention can be played by one or more players. For instance, in a multiplayer game, two or more players can alternate turns in opening tabs and following the clues.

The design or image on the playing surface can be based on any theme, including, but not limited to holidays, sports, fantasy, and cartoons.

The present invention is also envisioned as an educational tool. For example, the clues directing the player to the next tab may involve mathematical, language, alphabetical or visual skills.

The claimed invention can be made of any suitable consumer material. Ideally, the material is light, inexpensive, non-toxic, and water resistant. Examples of suitable materials include, but are not limited to polymers, such as plastic, and cellulose-based materials, such as cardboard or paper. In the preferred embodiment, the material is coated or laminated paper, or layers of paper which are coated or laminated.

Figure 2:
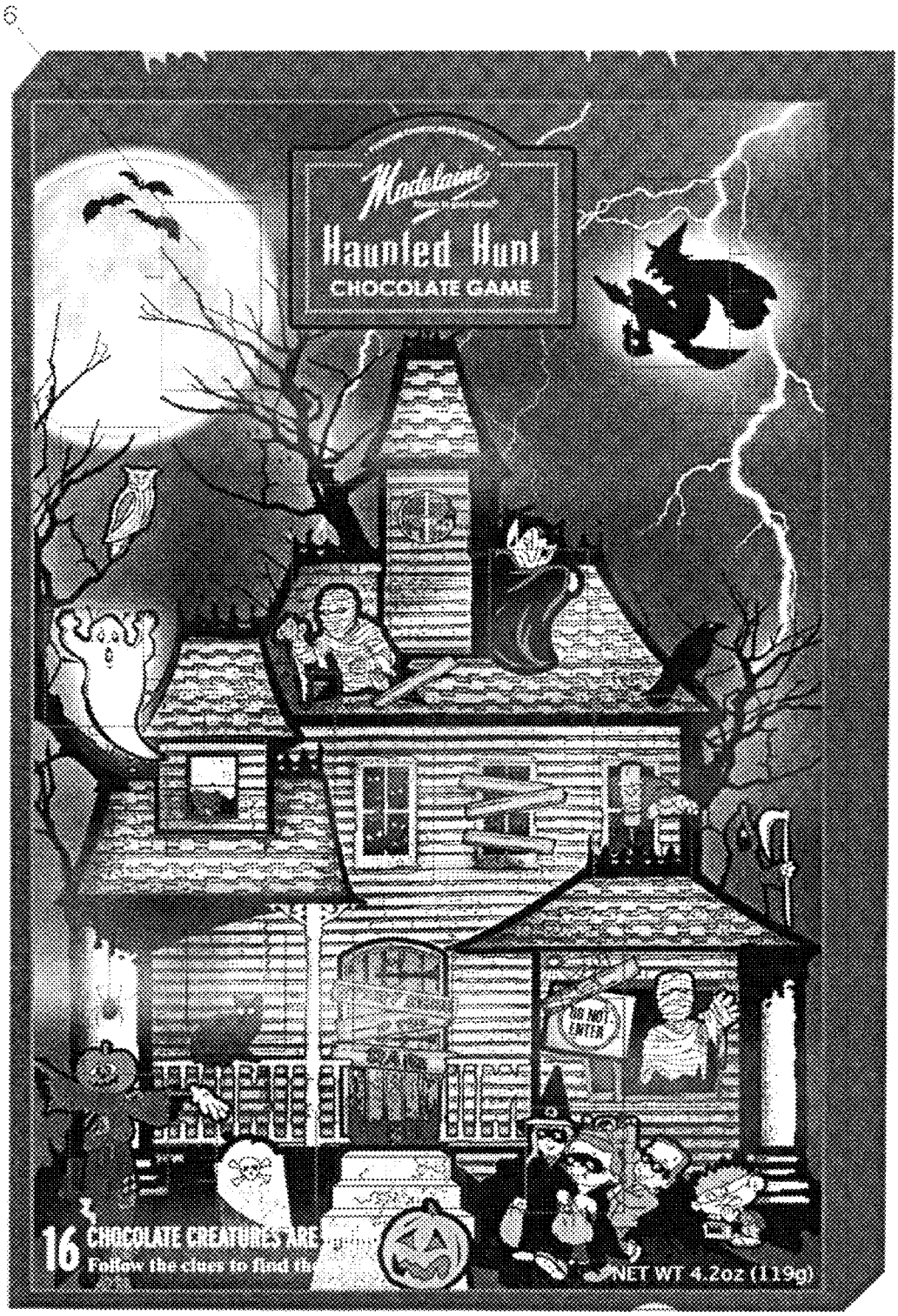
FIG. 2 shows the top view of one embodiment of the claimed invention bearing a Halloween theme. Here, (6) indicates the location of one of the tabs.
Figure 3:
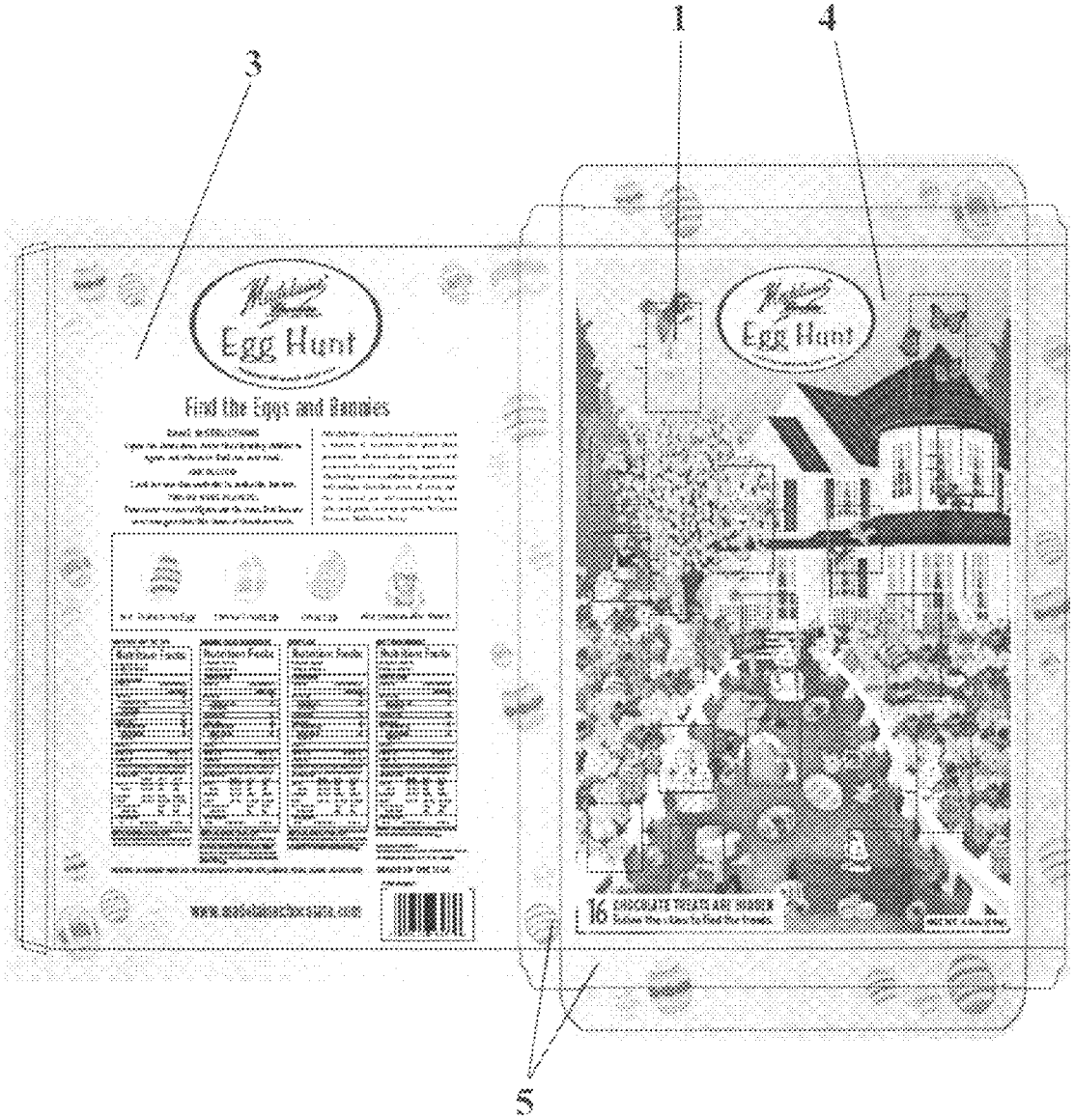
FIG. 3 shows another embodiment of the claimed invention bearing an Easter theme. Here, the invention is shown as a one-piece cutout, which when properly folded, would provide a rectangular box comprising the claimed board game. (3) indicates the bottom exterior surface of the board game and provides game instructions, company information, candy ingredients and other information. (4) indicates the top exterior surface of the board game. (5) indicates the outer wall. (1) indicates the location of one of the tabs.
Figure 4:
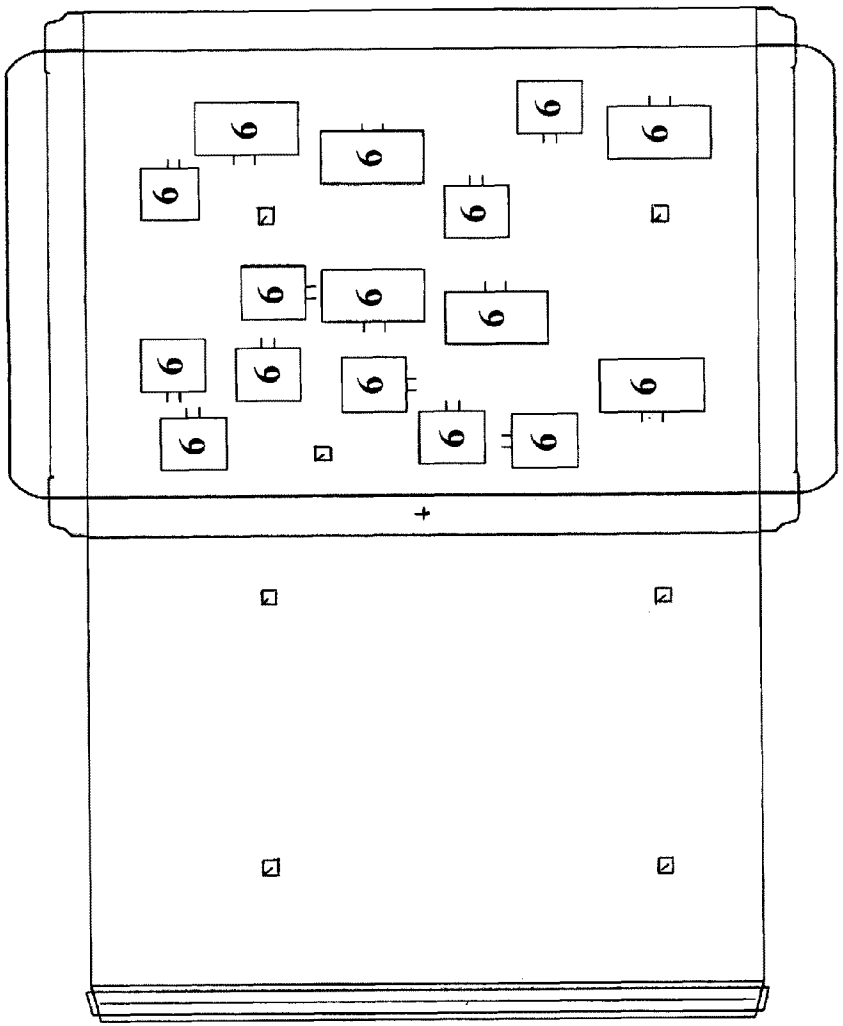
FIG. 4 shows the opposite side of the one-piece cutout shown in FIG. 3. The boxes (9) correspond to the back side of each tab on the top panel, upon which is printed text or an image (not shown), so that opening the tab outwards reveals the text or image to the player. The text or image for each tab is oriented based on the direction the tab is to be opened. The interior surface of the bottom panel is blank in this embodiment.
Figure 5:
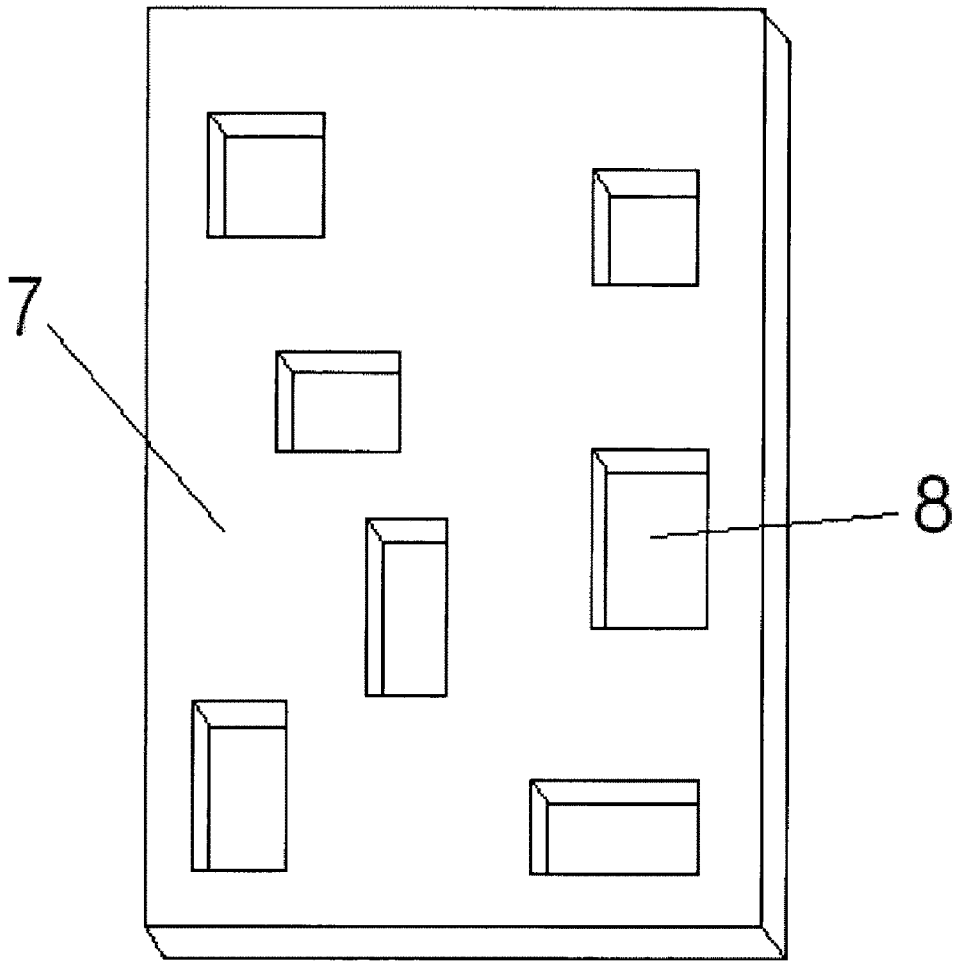
FIG. 5 shows one embodiment of an insert (7), specifically a plastic tray, to be placed between the lower and upper layers of the claimed invention. Cavities or individual cells (8) are located throughout the plastic tray. In this embodiment, the cavities or individual cells are indentations in the plastic tray (i.e., the cavities or cells are not holes in the insert). Each cavity can hold a prize and are aligned with a tab located on the upper layer of the board game.

As described above, the claimed invention comprises a plurality of polygonal tabs, said tabs having a front and a back surface, wherein the tabs are moveable from a closed to an open position. Preferably, the tabs are produced so as to allow repeated opening and closing of the tab. In the most preferred embodiment, the tabs are formed via perforations in the playing surface. In this embodiment, a portion of the tab is left attached (non-perforated) so as to function as a hinge. The orientation of the hinge of a tab can vary, so as to create tabs that swing open in any direction (e.g. left to right, right to left, top to bottom, and bottom to top). As used herein, "polygonal" shall mean any plane figure consisting of a finite number of edges. As shown in FIGS. 1-4, the tabs are rectangular shaped. However, it is envisioned that any shape with a portion sufficient to function as a hinge can be used as a tab in the claimed invention. The length of the game can also be adjusted by varying the number of tabs on the playing surface. Preferably, the claimed invention contains between 10 and 40 tabs, but can be any number depending on the size of the playing surface. For example, the embodiments of the claimed invention set forth in FIGS. 1-4 have 16 tabs each.

Three-Dimensional Interactive Board Game

Also envisioned is an embodiment having a three-dimensional structure. All permutations described above for the two-dimensional embodiment are applicable to the three-dimensional embodiment. However, additional advantages and characteristics are available through the three-dimensional structure of this embodiment.

Therefore, the present invention is further directed to a board game apparatus comprising (a) a lower layer having a first top surface, (b) an upper layer located above the lower layer and having a second top surface, (c) an outer wall connecting the border of the lower layer to the border of the upper layer, (d) a plurality of polygonal tabs formed in said upper layer, said tabs having a front and a back surface, wherein the tabs are moveable from a closed to an open position, (e) a design or image printed on said second top surface, wherein the design or image contains no indication of the order of the tabs to be opened, and (f) a plurality of printed text or images on the back surface of each tab or on the first top surface of the lower layer viewable upon opening of the tab, wherein the printed text or image provides a clue or directions to the next tab to be opened. One such embodiment of this invention is set forth in the one piece cut-out shown in FIG. 3.

As described above for the two-dimensional embodiment, the printed text or images can appear on the back surface of the tab. Additionally, due to the three-dimensional structure of this embodiment, the printed text or images can be printed on the top surface of the lower layer of the invention. In the preferred embodiment, the tabs are formed via perforations in the upper layer of the apparatus.

As described above, the lower and upper layers of this embodiment are joined by an outer wall. In a preferred embodiment, the claimed invention is a flat rectangular box. Ideally, there is an opening in the outer wall, such as a flap, which allows placement of an insert within the space created between the lower and upper layers. In one embodiment, the insert forms individual cells or cavities located underneath each tab in the upper layer. The insert can be made of any one of a number of suitable materials, such as plastic or paper. In one embodiment, the insert is removable. The preferred embodiment of the insert is a plastic tray comprising cells or cavities, wherein each cell or cavity aligns with a tab located on the upper layer.

As an additional element to the game, a prize can be placed in each cell or cavity of the insert, which are then retrieved and awarded upon opening the tabs. Suitable prizes include, but are not limited to, confections, tokens, trinkets and toys. In the preferred embodiment, the confection is a chocolate.

While the invention has been disclosed in its preferred forms, it will be apparent to those skilled in the art that many modifications, additions and deletions can be made without departing from the spirit and scope of the invention and its equivalents set forth in the following claims.

What is claimed is:

1. A board game apparatus comprising:

a playing surface, wherein the playing surface comprises a plurality of polygonal tabs, the tabs having a front surface, a back surface, and an outline comprising a plurality of edges, wherein at least two of the plurality of edges comprise a plurality of perforations and at least one of the plurality of edges is adapted to function as a hinge along a fold line, wherein each of the tabs are moveable from a closed to an open position by tearing the playing surface along the plurality of perforations and folding each of the tabs about the fold line;

a bottom surface below the playing surface;

an outer wall connecting a border of the playing surface to a border of the bottom surface;

an insert between the bottom surface and the playing surface, and at least partially surrounded by the outer wall, wherein the insert comprises a plurality of individual cells that each align with one of the plurality of tabs;

a design or image printed on the playing surface, wherein the user is provided with a clue or direction as to a first tab to be opened and the design or image contains no indication of an order of successive tabs to be opened; and printed text or an image located on the back surface of or underneath the first tab associated with a design or image printed on a front surface of a successive tab to be opened, wherein the design or image printed on the front surface of the successive tab to be opened contains no indication of an order of a next successive tab to be opened.

2. The board game apparatus of claim 1, wherein printed text or an image on the back surface of or underneath the successive tab directs a user to a section of the printed design or image on the playing surface corresponding to a location of a next successive tab to be opened.

3. The board game apparatus of claim 1, wherein the apparatus is made of a cellulose material.

4. The board game apparatus of claim 3, wherein the cellulose material is coated or laminated paper, or layers of paper that are coated or laminated.

5. The board game apparatus of claim 1, wherein the insert is removable.

6. The board game apparatus of claim 1, wherein the outer wall is adapted to be folded to form a wall around at least one opening adapted to allow access to a space between the playing surface and the bottom surface.

7. The board game apparatus of claim 6, wherein the insert is provided through the at least one opening.

8. The board game apparatus of claim 7, wherein the insert is a plastic tray.

9. The board game apparatus of claim 7, wherein the individual cells are capable of containing a prize such that the prize is accessible upon opening one of the tabs.

10. The board game apparatus of claim 9, wherein the prize is a confection.

11. The board game apparatus of claim 10, wherein the confection is a chocolate.

12. The board game apparatus of claim 9, wherein the prize is a toy.

13. A board game apparatus comprising:

a lower layer having a first top surface, above the lower layer an upper layer having a second top surface, and an outer wall connecting a border of the lower layer to a border of the upper layer;

a plurality of polygonal tabs formed in the upper layer, the tabs having a front surface, a back surface, and an outline comprising a plurality of edges, wherein at least two of the plurality of edges comprise a plurality of perforations and at least one of the plurality of edges is adapted to function as a hinge along a fold line, wherein each of the tabs are moveable from a closed to an open position by tearing the playing surface along the perforations and folding each of the tabs about the fold line;

an insert between the lower layer and the upper layer, and at least partially surrounded by the outer wall, wherein the insert comprises a plurality of individual cells that each align with one of the plurality of tabs;

a design or image printed on the second top surface, wherein the user is provided with a clue or direction as to a first tab to be opened and the design or image contains no indication of an order of successive tabs to be opened; and printed text or an image located on the back surface of or underneath the first tab associated with a design or image printed on a front surface of a successive tab to be opened, wherein the design or image printed on the front surface of the successive tab to be opened contains no indication of an order of a next successive tab to be opened.

14. The board game apparatus of claim 13, wherein printed text or an image on the back surface of or underneath the successive tab to be opened is associated with a section of the printed design or image on the second top surface corresponding to a location of a next successive tab to be opened.

15. The board game apparatus of claim 13, wherein the apparatus is made of a cellulose material.

16. The board game apparatus of claim 15, wherein the cellulose material is coated or laminated paper, or layers of paper that are coated or laminated.

17. The board game apparatus of claim 13, wherein the insert is removable.

18. The board game apparatus of claim 13, wherein the outer wall is adapted to be folded to form a wall around one or more openings, wherein at least one opening allows access to a space between the lower and upper layers.

19. The board game apparatus of claim 18, wherein the insert is provided through the at least one opening.

20. The board game apparatus of claim 19, wherein the insert is a plastic tray.

21. The board game apparatus of claim 19, wherein the individual cells are capable of containing a prize such that the prize is accessible upon opening one of the tabs.

22. The board game apparatus of claim 21, wherein the prize is a confection.

23. The board game apparatus of claim 22, wherein the confection is a chocolate.

24. The board game apparatus of claim 21, wherein the prize is a toy.

* * * * *